United States Patent [19]

Constantin

[11] Patent Number: 5,071,284

[45] Date of Patent: Dec. 10, 1991

[54] ROAD MAINTAINER

[76] Inventor: Walter P. Constantin, 200 S. Eastern St., Rayne, La. 70578

[21] Appl. No.: 566,624

[22] Filed: Aug. 13, 1990

[51] Int. Cl.[5] ..... E01C 23/08; E01C 23/12; E01C 7/06

[52] U.S. Cl. ..... 404/75; 404/91; 404/90

[58] Field of Search ..... 404/75, 90, 91, 118

[56] References Cited

U.S. PATENT DOCUMENTS

| | | | |
|---|---|---|---|
| 1,330,783 | 2/1920 | Chase et al. | 404/118 X |
| 2,128,889 | 9/1938 | Allen | 404/118 |
| 2,787,846 | 4/1957 | Everds et al. | 404/118 X |
| 4,244,662 | 1/1981 | Olsen | 404/118 |
| 4,568,219 | 2/1986 | Berry | 404/118 |

*Primary Examiner*—Ramon S. Britts
*Assistant Examiner*—Nancy P. Connolly
*Attorney, Agent, or Firm*—Ned L. Conley

[57] ABSTRACT

A road surface conditioning machine having an adjustable height shearing blade, side delivery blades, and an adjustable height striker blade to spread the material cut by the shearing blade and side delivery blades, the leading end of the shearing blade being adjustable in height with respect to the trailing end.

8 Claims, 2 Drawing Sheets

ROAD MAINTAINER

This invention is in a machine for reconditioning the surface of a non-hard surfaced road, i.e. one in which the road surface is made of a pulverulent material such as sand, clay, gravel or shell.

During use, and particularly during use when the road is wet, the surface of such a road becomes rougher and rougher until it becomes a very poor driving surface. The roughness will occasionally include potholes, but the primary roughness is from a rubboard type surface, i.e. a continuous shallow wave-like surface with the valleys between the crests being no more than ½ inch to ¾ inch deep. When a vehicle is driven on such a surface, the roughness causes such vibrations as to often cause damage to the vehicle, and at higher speeds can be dangerous. Moreover, it is extremely uncomfortable for riders in the vehicle.

Because of this, the governmental agencies charged with maintaining such roads must recondition the surfaces of the roads several times a year. In many rural locations, such non-hard surfaced roads may constitute a majority of the roads, and often expenditure for maintaining such roads constitutes the major cost of the governmental body.

In the past, the most common equipment for maintaining such roads is the commonly known self-propelled road grader, comprising a large machine weighing as much as 40,000 pounds. Such machines were originally designed for cutting ditches alongside the road, but are often the only equipment available for maintaining road surfaces, and are therefore used for that purpose. Such a machine has a single blade which is used to cut the crests of the bumps as the machine moves down the road, and to spread the cut material on the road to restore the surface. This requires the machine to make three or more passes down the road to remove the bumps from the usual two lane road and then three or four additional passes to spread the material smoothly on the surface and thereby restore the surface.

The original cost of such road graders, together with the cost of operating and maintaining them, is so great that often the governmental body cannot afford to recondition the roads often enough to keep them comfortable and safe.

According to this invention, a road maintaining machine is provided which is not self-propelled, but is pulled by an ordinary tractor and which has a total weight and cost which is a fraction of that of the usual road grader. Furthermore, the road maintainer of this invention is designed so that it can cut the surface of the road and spread the cut material in a single path, so that in three passes a machine one lane wide can completely resurface the usual two lane road. The road maintainer includes a middle buster cutting blade which can be adjustably set to cut to the desired depth and which delivers cuttings to a pair of side delivery blades. These side delivery blades in turn cut more material from the road surface and deliver the cut material to an adjustable height striker blade which spreads the cut material to the desired width and at uniform thickness across the road. Thus the machine cuts and spreads in a single pass. The middle buster blade and the side blades are adjustable vertically to cut deeper at the trailing ends of the blades to compensate for the tendency of the blades to wear more at their leading ends.

DESCRIPTION OF THE PREFERRED EMBODIMENT

Figure 1:
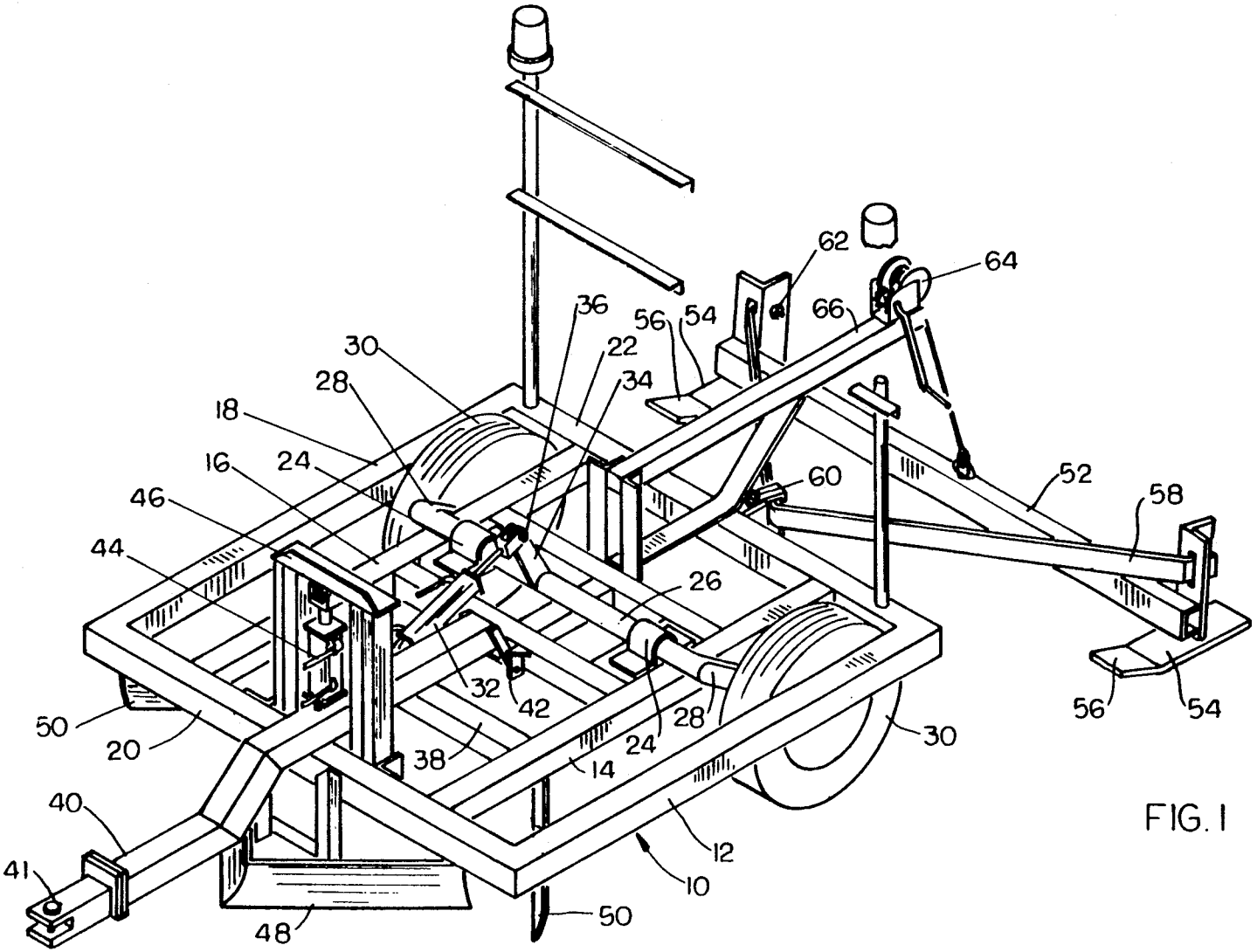
FIG. 1 of the drawing is a perspective view of a preferred embodiment of the road maintainer of the present invention.
Figure 4:
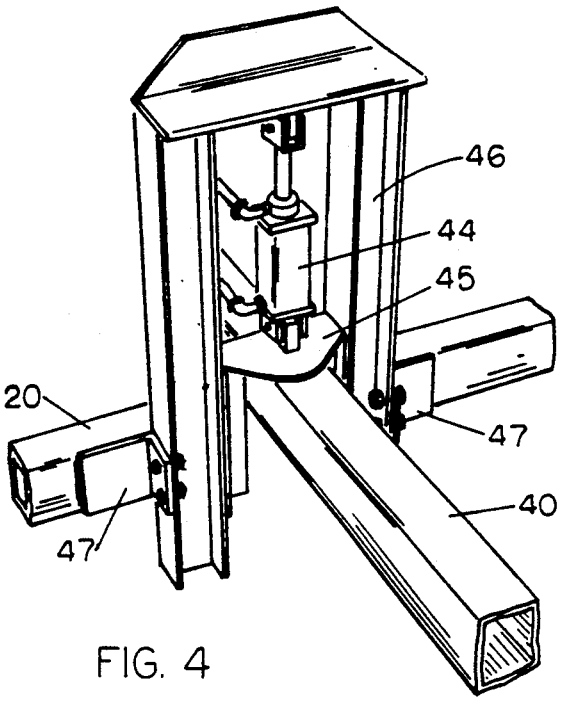
FIG. 4 is a fragmentary perspective view of a portion of the embodiment of FIG. 1.
Figure 5:
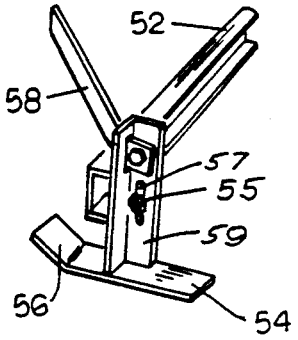
FIG. 5 is a fragmentary perspective view of another portion of the embodiment of FIG. 1.
Figure 3:
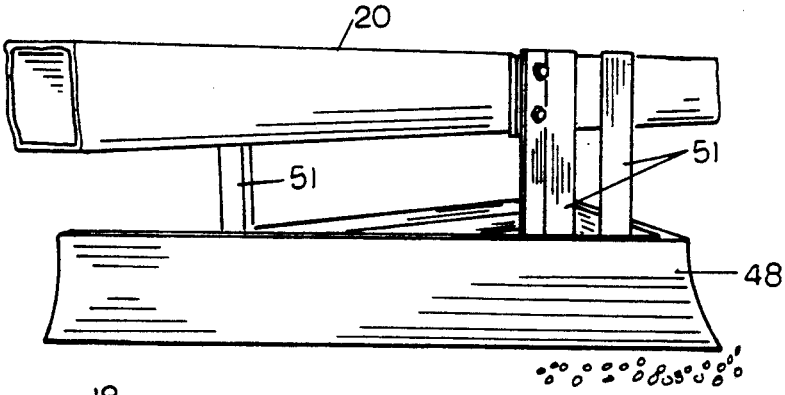
FIG. 3 is an elevational view of another portion of the embodiment of FIG. 1.
Figure 2:
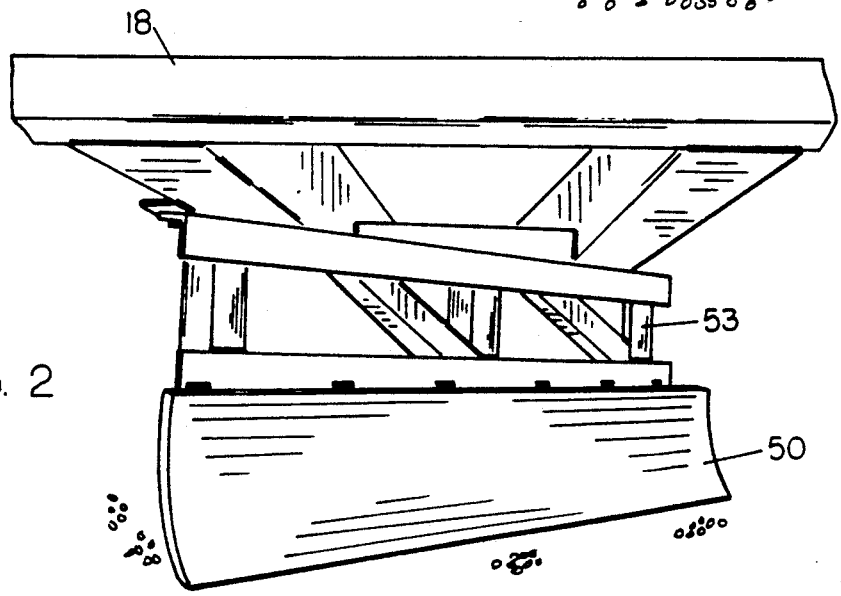
FIG. 2 is an elevational view of a portion of the embodiment of FIG. 1.

The preferred embodiment of the road maintainer according to this invention includes a main frame 10 which lies in a substantially horizontal plane and comprises a plurality of metal structural members, preferably steel, including longitudinally extending beams 12, 14, 16 and 18 and front and rear transversely extending beams 20 and 22, connected together as by welding. The main frame has mounted thereon a pair of pillow block bearings 24 which rotatably support a transversely extending shaft 26. At each end of shaft 26 is a mounting arm 28. Each mounting arm supports a spindle for mounting one of the wheels 30. The shaft 26 may be rotated to cause the frame to be moved upwardly and downwardly on the wheels by means of a fluid cylinder 32 whose piston rod is pivotally connected to the shaft 26 through an arm 34 and a pivot pin 36. The base of the cylinder is pivotally mounted on a cross bar 38 of the main frame.

A pair of light standards 35, surmounted by lights 37, are mounted on the rear of the main frame, and are connected together by braces 39, on which may be mounted a warning sign or the like.

The road maintainer of this invention is pulled through a draw bar 40 which extends longitudinally forwardly of the center of the main frame and is pivotally mounted near the longitudinal center of the main frame through a mounting bracket 42. The draw bar may be connected to the tractor hitch through a conventional clevis-type connection 41 as shown, which allows pivoting in a horizontal plane and limited pivoting in a vertical plane, or through a ball and socket type hitch which allows pivoting in any direction. A hydraulic cylinder 44 is pivotally mounted on a plate 45 on the draw bar intermediate its ends and is pivotally connected to the main frame through the U-shaped truss 46 which is attached, as by bolts in brackets 47, to the front cross bar 20 of the main frame. The legs of the truss 46 extend downwardly below the cross bar 20 and are slidably engaged by guides 49 which are affixed, as by welding, to plate 45, and serve to restrict lateral movement of the draw bar with respect to the main frame.

A middle buster 48 is rigidly mounted by suitable structural steel members 51 below the front portion of the main frame, and lies in a plane parallel to the plane of the main frame. The middle buster is centrally disposed laterally of the main frame and includes a pair of conventional shearing or cutting blades mounted to form a forward facing V having an angle of from about 60° to about 100°, preferably about 80°. As shown, and as is well known, such blades are somewhat arcuate in cross-section, and are adapted to engage the road surface at an acute angle, so that the blade will cut into the surface and shear material from it as it is pulled along the road. As the blade shears the road, the blade itself is worn by the abrasive materials encountered, such wear also maintaining a sharp cutting edge on the blade.

A pair of side delivery blades 50 are carried rigidly mounted on a frame 53 beneath the main frame rearwardly of the middle buster, one side delivery blade on each side of the trailing edges of the middle buster, these blades having their leading edges spaced outwardly from the trailing edges of the middle buster and their trailing edges spaced inwardly of the trailing edges of the middle buster, so that the side delivery blades angle rearwardly at an angle of from 30° to 60°, preferably about 40°, to the longitudinal centerline of the machine. These blades are also conventionally arcuate in cross-section, with a lower cutting edge, and serve to cut into the road surface laterally outwardly from the middle buster, and to deliver cut material in two ridges toward the longitudinal center of the machine.

The floating striker blade 52 is pulled behind the main frame of the road maintainer and consists of a substantially horizontal transversely extending beam at least as long as the width of the side delivery blades. The striker blade is vertically adjustably mounted on a pair of sleds 54 which slant upwardly at their forward ends 56 to allow the sleds to skid along the surface of the road without digging in. Vertical adjustment of the striker blade on the sleds is accomplished by means of mounting bolts 55 which pass through vertical slots 57 in sled support brackets 59. The striker blade is pulled by means of a pair of angularly divergent bars 58 which are pivotally mounted at 60 to the rear center of rear transverse beam 22 of the main frame to allow the striker bar to be pivoted in the horizontal plane. The bars 58 are also pivotally mounted at 62 to allow pivoting of the striker blade for movement vertically with respect to the main frame, so that the striker blade floats and follows the contour of the road. Means such as a hand winch 64 are provided for raising and lowering the striker blade. The winch is mounted through a rearwardly extending support beam 66 which in turn is rigidly mounted on the main frame 10.

In use, the road maintainer of this invention may be drawn by a multi-use 30 to 40 horsepower tractor. The operator determines by observation the depth of cut that will be required to remove the ridges or crests of the bumps on the road and, by adjustment of wheel height with hydraulic cylinder 32, or of the height of the front end of the main frame by cylinder 44, lowers the middle buster 48 far enough to cut into the road the necessary depth. It may be necessary to make trial and error adjustments in order to achieve a satisfactory depth to substantially remove the ridges while not significantly disturbing the road bed below the valleys between the ridges.

The middle buster blade tends to wear more at the point of the V than at the trailing end of the blade, and the side delivery blades also tend to wear more at their leading ends. In order to even out the wear on the blades, it is desirable to apply more pressure at the trailing ends. This is readily accomplished by raising the front of the machine with hydraulic cylinder 44 and lowering the rear of the machine with cylinder 32 to the desired cutting depth. This results in the trailing ends of the blades cutting more deeply and wearing more than the leading ends. To even out the wear on the blade, the operator should check the blades each day to see how much it was worn in the previous day's work, and tilt the machine enough to compensate for any differences in wear between the leading and trailing edges. Usually a tilt of $\frac{1}{8}$ to $\frac{1}{4}$ inch per day will be sufficient, but in very abrasive materials, it may be necessary to adjust the blades twice a day.

Such adjustments result in more uniform wear of the blades. As a result, substantially the entire cutting portion of the blades can be used before it is necessary to replace them. Prior art grading blades which do not have this compensation feature normally must be discarded when only half used because of the non-uniformity of wear.

As the road maintainer of this invention is pulled down the road, the middle buster shears off the high ridges in the road, leaving the road bed underneath the valleys intact and pulverizing the road material. This pulverized material is deposited on the road bed at the outer extremity of the two blades of the middle buster where it is picked up by the side delivery blades 50. These blades in turn shear off the high ridges in the road laterally outwardly from the middle buster, and leave two ridges of material nearer the center of the road maintainer. The striker blade then serves to spread the material, leaving a smooth surface throughout the width of the portion of the road surface cut by the shearing blades. The striker blade is set to a height which is sufficient to fully spread the pulverized material without leaving a substantial amount of excess material which will flow around the ends of the blade. The exact height to which the striker blade should be set can be determined by trial and error. As the operator becomes more experienced he will know what setting to use to spread the material for various types of material being graded. For example on a gravel road, setting the striker blade about 2 inches above the road bed gives a good distribution of the material, whereas on a sand road a setting of 1 inch usually provides a fairly smooth surface.

By cutting and spreading the road material in a single pass, a road maintainer of this invention which is eight feet wide can resurface a two lane road in three passes, whereas a conventional road grader, which must cut and spread in separate passes, would require six or more passes.

A major advantage of the road maintainer of this invention is that it can be adjusted to cut into even an extremely hard road surface, such as tightly compacted gravel or a caliche surface, and will cut loose the crests of the bumps in such a manner as to provide a smooth undisturbed bed surface and at the same time pulverize the material removed so that it can be laid on top of the newly formed surface. Since the main bed of the road is not disturbed, the reconditioning job can be expected to last much longer than is the case when the old style road graders are used which often cut into and pulverize the entire surface and also the subsurface material.

Moreover, the use of the road maintainer of this invention costs far less than the use of the usual road grader and in some cases may be expected to cost as little as 10% of the cost currently incurred.

Although a preferred embodiment of the invention has been shown and described, the invention is not limited to the specific embodiment disclosed, but includes all variations thereof within the scope of the accompanying claims, together with equivalents. For example, other means may be substituted for the hydraulic cylinders, and other adjustment arrangements may be used to achieve the desired height and tilting of the blades.

I claim:

1. A road maintainer comprising:

a main frame having a front and a rear, a horizontally disposed shearing blade carried on said main frame to shear material from the surface of a road, said shearing blade comprising a pair of blades connected together at the leading end of each to form a V pointed forwardly of said main frame, with the cutting edge of said blades facing forward, wheel means supporting said main frame for movement along a path, means for raising and lowering the main frame on said wheel means, whereby the shearing blade height can be adjusted to a position in which it will shear material from the road when the road maintainer is moved forwardly on a road, a drawbar on said main frame and extending forwardly therefrom for connection to a vehicle for pulling the road maintainer, a pair of side delivery blades on said main frame positioned rearwardly of the shearing blade, one on each side of the main frame and each having a leading end spaced outwardly and rearwardly of the trailing end of the shearing blade and a trailing end spaced inwardly and rearwardly from its leading end, whereby material sheared by the shearing blade is guided inwardly and deposited in a ridge below the main frame along said path, means for adjusting the height of the front of said main frame with respect to said drawbar to tilt the main frame to vary the height of the leading ends of the shearing blade and the side delivery blades with respect to the height of the trailing ends, and a substantially horizontally and transversely disposed vertically adjustable striker blade carried on said main frame above the cutting edge of said shearing blade and rearwardly of said side delivery blades and substantially perpendicular to said path, said striker blade having a length at least equal to the cutting width of the shearing blade.

2. A method for reconditioning the surface of a non-hard surfaced road which comprises:

placing on the road a road maintainer having a shearing blade with a leading end and a trailing end and means for adjusting the shearing blade so that the leading end is at a different height than the trailing end, adjusting the relative heights of the leading and trailing ends of the shearing blade to compensate for expected excess wear near the leading end, and pulling the road maintainer along the road with the shearing blade engaging the road to shear material therefrom.

3. A road maintainer comprising a main frame having a front, a rear and opposed sides, said main frame being mounted on wheels to carry the road maintainer along a path, two horizontally disposed blades carried on said main frame and having cutting edge positioned to shear material from the surface of the road when the road maintainer is carried along said path, said blades being angled rearwardly from the opposed sides of the main frame, whereby material sheared from the surface of the road is deposited on the road bed intermediate the sides of the main frame, and a horizontally disposed striker blade carried on said main frame behind the other blades and above the cutting edges of said blades, said striker blade extending substantially perpendicularly to said path and at least the full cutting width of said blades, whereby when the road maintainer is moved along the path the striker blade engages the sheared material and spreads it across the sheared surface of the road in the same pass as the material is sheared.

4. A road maintainer as defined by claim 3 and including a shearing blade comprising a pair of blades connected together in a V-shape pointed forward substantially along the centerline of said main frame in front of said other blades to shear material from the center of said path, said shearing blade having a width such that sheared material is deposited in the path of said other blades.

5. A road maintainer as defined by claim 4 and including means for raising and lowering said main frame on said wheels, whereby the shearing blade height can be adjusted.

6. A road maintainer as defined by claim 5 and including means for adjusting the height of said striker blade to vary the depth to which the sheared material is spread.

7. A method for reconditioning the surface of a non-hard surfaced road comprising transporting a road maintainer along a path lengthwise of the road, shearing material from the road surface, depositing the sheared material along said path intermediate the lateral extremes of the sheared surface, during the same pass of said road maintainer along said path, engaging sheared material with a striker blade mounted on the road maintainer to the rear of the shearing blade and above the sheared surface of the road, and spreading and smoothing the sheared material with the striker blade substantially the full width of the sheared surface.

8. A method as defined by claim 7, and including adjusting the height of the road maintainer to shear material to a desired depth, and adjusting the height of the striker blade to spread the sheared material to a desired depth.

* * * * *